US006239538B1

(12) United States Patent
Konuma

(10) Patent No.: US 6,239,538 B1
(45) Date of Patent: May 29, 2001

(54) FIELD EMITTER

(75) Inventor: Kazuo Konuma, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/154,838

(22) Filed: Sep. 17, 1998

(30) Foreign Application Priority Data

Sep. 17, 1997 (JP) ..... 9-251213

(51) Int. Cl.[7] ..... H01J 1/00
(52) U.S. Cl. ..... 313/309; 313/336; 313/351
(58) Field of Search ..... 313/309, 495, 313/497, 496, 336, 351

(56) References Cited

U.S. PATENT DOCUMENTS

| | | | | |
|---|---|---|---|---|
| 4,379,250 | | 4/1983 | Hosoki et al. . | |
| 5,059,792 | | 10/1991 | Kaga . | |
| 5,235,244 | * | 8/1993 | Spindt | 313/495 |
| 5,278,472 | | 1/1994 | Smith et al. . | |
| 5,463,277 | | 10/1995 | Kimura et al. . | |
| 5,689,151 | * | 11/1997 | Wallace et al. | 313/495 |
| 5,720,640 | * | 2/1998 | Lu et al. | 313/495 X |
| 5,734,223 | | 3/1998 | Makishima et al. . | |
| 5,789,857 | * | 8/1998 | Yamamura et al. | 313/495 |
| 5,844,360 | * | 12/1998 | Jeong et al. | 313/495 |

FOREIGN PATENT DOCUMENTS

| | | |
|---|---|---|
| 56-59422 | 5/1981 | (JP) . |
| 59-78431 | 5/1984 | (JP) . |
| 60-225345 | 11/1985 | (JP) . |
| 62-287548 | 12/1987 | (JP) . |
| 64-12450 | 1/1989 | (JP) . |
| 1-45695 | 10/1989 | (JP) . |
| 3-133022 | 6/1991 | (JP) . |
| 56-99941 | 8/1991 | (JP) . |
| 4-155738 | 5/1992 | (JP) . |
| 6-223705 | 8/1994 | (JP) . |
| 8-129981 | 5/1996 | (JP) . |
| 8-138561 | 5/1996 | (JP) . |

OTHER PUBLICATIONS

"Micro–Beam Analysis" published by K.K. Asakura Shoten, Jul. 15, 1990, p. 94–103.

* cited by examiner

*Primary Examiner*—Ashok Patel
(74) *Attorney, Agent, or Firm*—Foley & Lardner

(57) ABSTRACT

There is provided a field emitter capable of efficiently maintaining the temperature of an emission point at a constant temperature. Electrons are supplied to the emission point for emitting electrons, through both two routes which are composed of a first cathode in contact with a first cathode base conductor, and a second cathode, respectively. The first cathode and the second cathode are contacted at the emission point. The first cathode and the second cathode are insulated from each other by using a conical insulator layer. A gate metal film is provided for applying a strong electric field to the emission point. A gate metal film, the second cathode and the first cathode base conductor are connected to a gate applying wiring conductor, a second cathode wiring conductor and a first cathode wiring conductor, respectively.

9 Claims, 5 Drawing Sheets

FIELD EMITTER

BACKGROUND OF THE INVENTION

1. Field of the Invention

The present invention relates to a field emitter, and more specifically to a field emitter for emitting electrons from a sharpened projection.

2. Description of Related Art

The prior art field emitter will be described with reference to FIGS. 1A to 1C. FIG. 1A illustrates a field emitter used in an electron gun of an electron microscope. It has a structure having a sharpened needle 32 fixed to a filament 31 formed of a resistance wire of a refractory metal. This structure is disclosed in Japanese Patent Application Post-examination Publication No. JP-B-01-045695 (corresponding to U.S. Pat. No. 4,379,250) (called "Reference A" hereinafter) and Japanese Patent Application Pre-examination Publication No. JP-A-56-099941 (called "Reference B" hereinafter).

FIG. 1B shows the field emitter called a "micro field emitter". This micro field emitter is disclosed in, for example, C. A. Spindt et al's article carried in Journal of Applied Physics, Vol. 47, page 5248, 1976.

In FIG. 1B, the micro field emitter includes a resistor 35 formed through a contact part 34 on a conductive substrate 33, and a molybdenum projection 36 formed to be electrically connected to the resistor 35. This molybdenum projection 36 is accommodated in a cylindrical hole formed in an insulator film 37 and a gate metal film 38. In addition, the resistor 35 is surrounded by a separation layer 39.

An equivalent circuit of the field emitters shown in FIG. 1A and FIG. 1B is as shown in FIG. 1C. This equivalent circuit is constituted of a resistor A-B, a resistor B-C and a resistor B-D, and electrons are supplied from resistor ends A and C. Expressing this supplying of electrons in different words, this is a supplying of an electric current (having a negative sign). Electrons are emitted from a resistor end D into vacuum. Here, the signs A, B, C and D are used in common to FIGS. 1A to 1C.

It was reported in the above referred References A and B and Japanese Patent Application Pre-examination Publication No. JP-A-08-129981 (called "Reference B" hereinafter) that in the prior art field emitters as mentioned above, stability of emission is a problem.

It is known that the stability of emission depends upon a residual gas surrounding the field emitter and the temperature of a tip end of the field emitter. As a countermeasure for stabilization, the above referred References A and B propose to heat the filament by causing an electric current to flow through the filament, so as to control the temperature of the sharpened needle fixed to the filament for the purpose of stabilization An operation in the above referred References A and B will be now explained with reference to FIG. 1C. Independently of a slight current caused to flow to the resistor B-D for the electron supplying, a current is supplied through a series-connected resistor formed of the resistor A-B and the resistor B-C so as to control the temperature by means of the resistance heating.

On the other hand, the Reference C provides a filament for the purpose of emitting a gas, independently of the field emitter used as an electron source of the electron gun, in one vacuum container, so that the residual gas is controlled by controlling the supplying of the power to the gas emitting filament, for the purpose of stabilizing the emission of the field emitter.

In the technology disclosed in the Reference C, since the gas emitting filament has to be located at a position which gives no influence to the function of the electron gun, the device inevitably becomes large in size, and also, an extra wiring for the gas emitting filament becomes necessary.

In the technology disclosed in the References A and B, on the other hand, the sharpened needle, which is the member for actually emitting the electrons, is not directly heated, but the filament, which is the member for supporting the sharpened needle, is heated by means of the resistance heating, so that an emission position is heated by a conduction heating or a radiation heating. In this case, it is sufficient if only the tip end of the needle which is the emission position, is heated, however, a large heat capacity including the filament is actually heated.

Furthermore, in the technology disclosed in the References A and B, not only the power supplying is increased for the heating, but also a gas is generated from the heated filament and its peripheral structure heated, so that the residual gas is increased in the proximity of the tip end of the field emitter. This results in a vicious spiral in which if the residual gas is increased, the temperature of the emitter tip end is required to be higher than that required before the residual gas increases.

In the field emitter shown in FIG. 1A, it is a general practice that the filament has the total length of 5 mm. The micro field emitter includes one having the structure shown in FIG. 1B, in which when the current is caused to flow through the resistor, the heating effect is obtained similarly to the resistance heating obtained by causing the current to flow through the filament. However, in the structure shown in FIG. 1B, the current flowing through the resistor is the current for supplying the electrons which are emitted from the tip end of the molybdenum projection, the current is increased dependently with the increase of the emission amount.

Namely, there occurs a cause-and-effect relation in which if the emission amount increases, the temperature of the resistor increases. In this characteristic relation, even if the amount of emission is controlled with a high frequency, a rising characteristics becomes dull. This is because of the phenomenon that when the emission rises up, namely, in the course in which the emission increases, it becomes gradually easy to emit the electrons with the increase of the temperature. Under a similar principle, the falling characteristics also becomes dull. The frequency characteristics deterioration caused with the temperature dependency, depends upon the heat capacity of the resistor.

In both the structure shown in FIG. 1A and the structure shown in FIG. 1B, since the sharpened needle and the molybdenum projection, which are the structural member for emitting the electrons, are not directly heated, it is necessary to heat the large heat capacity including the peripheral structure.

SUMMARY OF THE INVENTION

Accordingly, it is an object of the present invention to provide a field emitter which has overcome the above mentioned problem and which can effectively maintain the temperature of the emission point at a constant temperature.

The field emitter in accordance with the present invention is a field emitter configured to cause electrons to be emitted from a sharpened projection by action of a field emission, the field emitter comprising a plurality of electron supplying conductors in contact with the projection.

Another field emitter in accordance with the present invention comprises first and second cathodes for supplying electrons to an emission point for emitting electrons by action of a field emission, and first and second cathode applying wiring conductors connected to the first and second cathodes, respectively.

Still another field emitter in accordance with the present invention comprises a first cathode for supplying electrons to an emission point for emitting electrons by action of a field emission, the first cathode having one end sharpened in the form of a conical tip end, a second cathode for supplying electrons to the emission point for emitting the electrons by action of the field emission, first and second cathode applying wiring conductors connected to the first and second cathodes, respectively, a conical insulator layer for insulating the first and second cathodes from each other, and a third cathode covering the emission point and surrounding the first cathode by cooperation with the conical insulator layer.

A further field emitter in accordance with the present invention comprises a first cathode for supplying electrons to an emission point for emitting electrons by action of a field emission, the first cathode having one end sharpened in the form of a conical tip end, and a second cathode for supplying electrons to the emission point for emitting the electrons by action of the field emission, the second cathode being connected to the other end of the first cathode, the total of the currents flowing through the first and second cathodes being equal to the amount of the electron flow emitted by action of the field emission.

Namely, the field emitter in accordance with the present invention is configured to cause the electrons to be emitted from the sharpened projection by action of a field emission, and comprises a plurality of electron supplying conductors in contact with the projection.

Alternatively, the field emitter in accordance with the present invention is configured to cause the electrons to be emitted from the sharpened projection by action of a field emission, and comprises a plurality of electron supplying conductors in contact with the projection, a contact therebetween being a rectifying contact.

Furthermore, the field emitter in accordance with the present invention is configured to cause the electrons to be emitted from the sharpened projection by action of a field emission, and comprises a plurality of electron supplying conductors in contact with the projection, one conductor of the plurality of electron supplying conductors is maintained in no contact with vacuum.

Moreover, the field emitter in accordance with the present invention is configured to cause the electrons to be emitted from the sharpened projection by action of a field emission, and comprises a plurality of electron supplying conductors in contact with the projection, and the total of the currents flowing through the plurality of electron supplying conductors is equal to the amount of the electron flow emitted by action of the field emission.

With the above mentioned arrangement, the field emitter in accordance with the present invention can selectively heat the projection for emitting the electrons. The current flowing between the plurality of electron supplying conductors generates a Joule heat by the resistance component of the conductor itself or the contact resistance in the projection, so that the projection is heated.

Furthermore, when a contact between the plurality of electron supplying conductors and the projection is a rectifying contact, it is possible to control the temperature elevation since the amount of the Joule heat generated by the resistance is different depending upon the direction of the current flowing through the conductors. Therefore, the temperature can be precisely controlled by frequently adjusting the current direction and the distribution in time of the current direction.

Still furthermore, when one of the plurality of electron supplying conductors is maintained in no contact with vacuum, it is possible to reduce the dissipation of the Joule heat generated in the conductor resistance component or the contact resistance by action of a radiation cooling, so that the heading efficiency of the electron emitting projection can be elevated.

Moreover, when the total of the currents flowing through the plurality of electron supplying conductors is made equal to the amount of the electron flows emitted by action of the field emission, since all of current used for the heating is emitted as the electrons, it is possible to make it unnecessary to flow an extra current for emission of electrons.

DESCRIPTION OF THE PREFERRED EMBODIMENTS

Figure 1A:
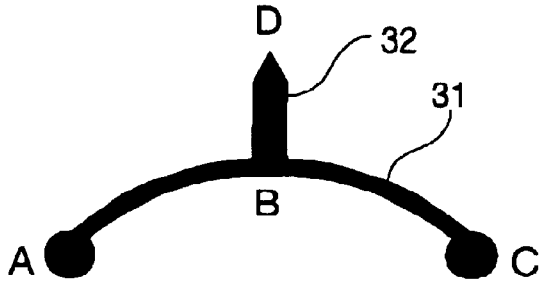
Fig. 1A PRIOR ART
FIG. 1A is a diagram illustrating one example of the structure of the prior art field emitter.
Figure 1B:
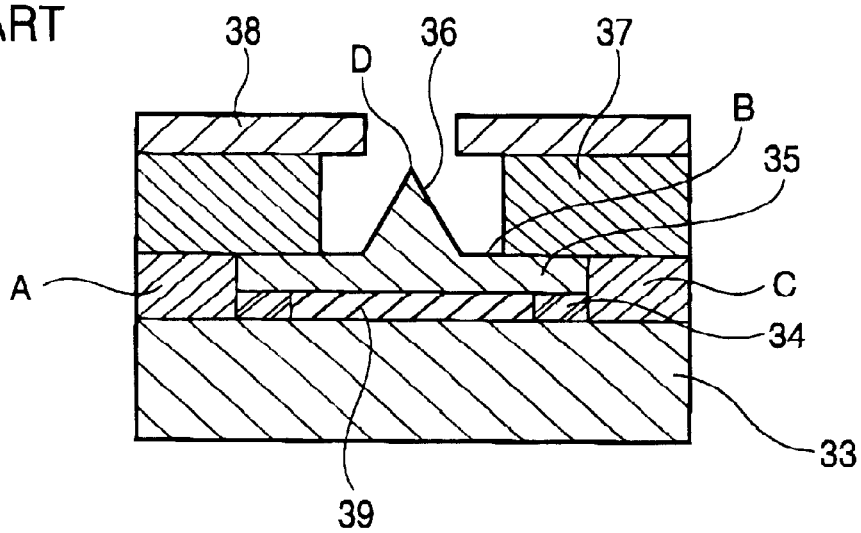
Fig. 1B PRIOR ART
FIG. 1B is a diagram illustrating another example of the structure of the prior art field emitter.
Figure 1C:
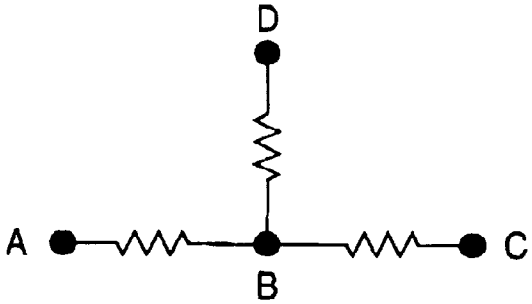
Fig. 1C PRIOR ART
FIG. 1C is a diagram illustrating an equivalent circuit of the prior art field emitters.
Figure 2:
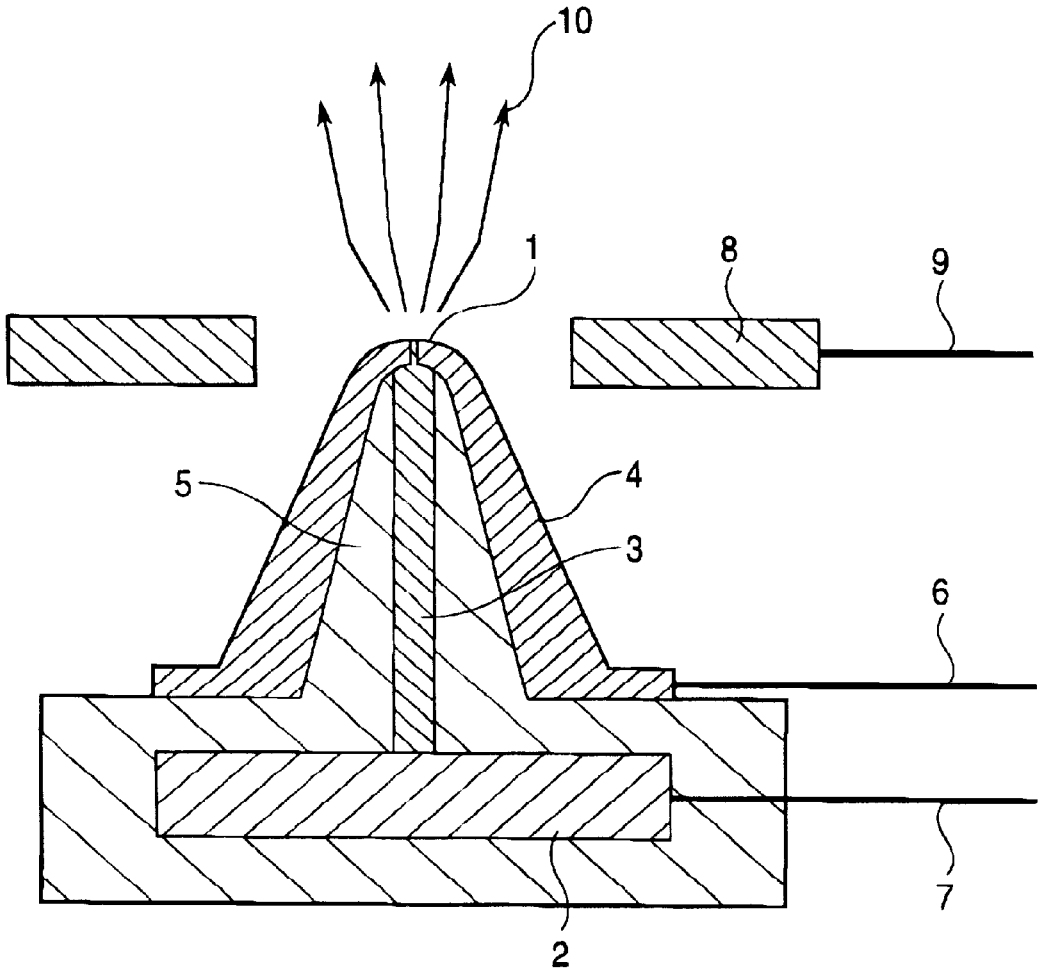
FIG. 2 is a sectional view illustrating the structure of a first embodiment of the field emitter in accordance with the present invention.

Now, embodiments of the present invention will be described with reference to the drawings. FIG. 2 is a sectional view illustrating the structure of a first embodiment of the field emitter in accordance with the present invention. In the drawing, the first embodiment of the field emitter in accordance with the present invention includes an emission point 1, a first cathode base conductor 2, a first cathode 3, a second cathode 4, a conical insulator layer 5, a second cathode applying wiring conductor 6, a first cathode applying wiring conductor 7, a gate metal film 8 and a gate applying wiring conductor 9.

In this structure, electrons are supplied to the emission point 1 for emitting electrons 10, from both of two routes, namely, the first cathode 3 connected with the first cathode base conductor 2, and the second cathode 4. The first cathode 3 and the second cathode 4 are contacted to each other at the emission point 1, and the first cathode 3 and the second cathode 4 are insulated from each other by the conical insulator layer 5.

The gate metal film 8 is provided to apply a strong electric field to the emission point 1. The gate applying wiring conductor 9, the second cathode applying wiring conductor 6 and the first cathode applying wiring conductor 7 are connected to the gate metal film 8, the second cathode 4 and the first cathode base conductor 2, respectively.

Now, a contacting condition in the emission point 1 will be described in detail. The first cathode 3 is formed of a wire made of molybdenum and having a diameter of 0.2 μm and a length of 1 μm. The first cathode 3 is so machined that one end constituting the emission point 1, has a sharpened conical shape. The first cathode 3 has a wiring resistance of 1Ω.

The conical insulator layer 5 is formed of $SiO_2$. The conical insulator layer 5 has a height of 0.7 μm in the axial direction of the first cathode 3, a base portion diameter of 0.6 μm, and a tip end diameter corresponding to the length obtained by adding a film thickness of about 0.01 μm to the sharpened conical molybdenum of the first cathode 3.

The second cathode 4 is formed of a molybdenum film having the thickness of 0.1 μm and covers the surface of the conical insulator layer 5. The second cathode 4 has a resistance of 5Ω. The film thickness of about 0.01 μm of the insulator layer 5 is so adjusted and formed that the contact resistance between the first cathode 3 and the second cathode 4 at the emission point 1 is 100Ω. This contact resistance is formed by utilizing a principle in which an electric current flows through a structure of a metal-insulator film-metal as hot electrons.

Figure 3:
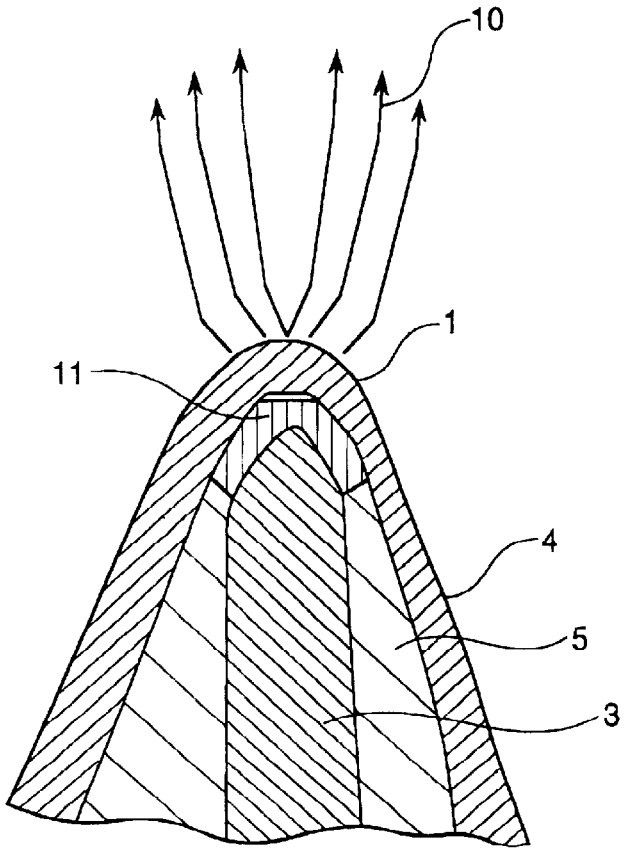
FIG. 3 is a partial enlarged view of the emission point 1 shown in FIG. 2.

FIG. 3 is a partial enlarged view of the emission point 1 shown in FIG. 2. In the drawing, the emission point 1 from which the electrons 10 are emitted, is in the range of not greater than 0.1 μm in diameter. The relation between the first cathode 3 having the diameter of 0.2 μm, the conical insulator layer 5 having the film thickness of 0.01 μm at the tip end portion, the second cathode 4 having the thickness of 0.1 μm, and actually emitted electrons 10 is as shown in FIG. 3.

Namely, the electrons are emitted from the inside of a thinned thickness region of the conical insulator layer 5. A tunnel current generating region 11 is a sharpened region of the first cathode 3, and has an area substantially equal to the area of the emission point 1.

Figure 4:
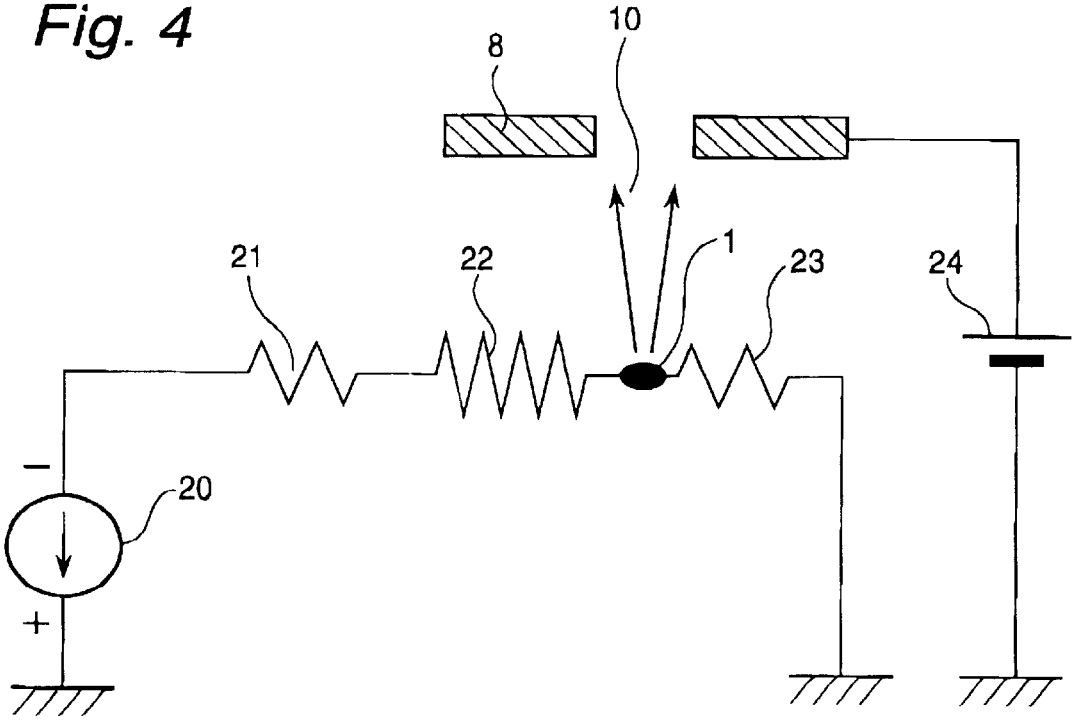
FIG. 4 is a diagram illustrating an equivalent circuit of the first embodiment of the field emitter in accordance with the present invention.

FIG. 4 is a diagram illustrating an equivalent circuit of the first embodiment of the field emitter in accordance with the present invention. Now, the manner of actually driving the first embodiment of the field emitter in accordance with the present invention will be described with reference to FIGS. 2 to 4.

A connection is made to the second cathode applying wiring conductor 6, the first cathode applying wiring conductor 7 and the gate applying wiring conductor 9, as shown in the equivalent circuit of FIG. 4, respectively. Namely, a constant current source 20 of 10 μA is connected to the first cathode applying wiring conductor 7, and is connected to ground through 1Ω of a resistance component 21 of the first cathode, 100Ω of a resistance component 22 of the tunnel current, and 5Ω of a resistance component 23 of the second cathode. A positive side of the current source 20 is connected to the ground.

The emission point 1 for emitting the electrons 10 is positioned between the tunnel current resistance component 22 and the second cathode resistance component 23. The gate metal film 8 is connected to a gate voltage source 24 which is a variable voltage source.

A typical electron emission characteristics is that when the gate voltage source 24 is in the range of 0 V to 40 V, the emission is 0 μA; when the gate voltage source 24 is 50 V, the emission is 0.1 μA; when the gate voltage source 24 is 60 V, the emission is 0.2 μA; and when the gate voltage source 24 is 70 V, the emission is 1 μA.

First, the situation when the gate voltage source 24 is 0 V, will be described with reference to the equivalent circuit. Since the current of 10 μA flows from the constant current source 20, a Joule heat corresponding to the electric power obtained by multiplying the resistance value 100Ω to a square of 10 μA, is generated in the tunnel current resistance component 22. Similarly, a Joule heat is generated in the other resistance components. A proportion of the magnitude of the Joule heats generated in the respective resistance components is equal to the proportion of the resistances of the respective resistance components.

A heating phenomenon by the Joule heat will be described with reference to FIG. 3. A heating area generated by the tunnel current resistance component 22 is the tunnel current generating region 11 in FIG. 3. This area is the range of about 0.01 μm in thickness and 0.2 μm in diameter. An actual temperature elevation is restricted to a very narrow area including the above area as a center and the proximity of the above area.

Since the heat is generated in the narrow area, the temperature elevation becomes remarkable. The temperature of the emission point 1 reaches the range of 200° C. to 300° C. with the current of 10 μA. If the current is increased by 10 μA, the temperature of the emission point 1 is correspondingly elevated. Comparing with the heat generated by this contact resistance of the tunnel current resistance component 22, the temperature elevation caused by the other resistance components which generate heat over a wide range, is negligibly small.

When the gate voltage source 24 is 70 V, the electron emission of 1 μA occurs in the emission point 1. In this case, a portion of the electron flow is emitted from the resistance circuit of the cathode portion, as the electrons 10 shown in FIG. 4.

This distribution of the electron flow will be now described in detail. The electron flow of 10 μA is supplied from the constant current source 20. When this electron flow of 10 μA is supplied to pass through 1Ω of the first cathode resistance component 21 and 100Ω of the tunnel current resistance component 22, the heat is generated. 9 μA obtained by subtracting the electron emission of 1 μA shown by the electrons 10, from the electron flow of 10 μA, flows through the second cathode resistance component 23. Since the amount of the electron flow flowing through the tunnel current resistance component 22 which is a dominating factor of the heat generation, is the same as that when the gate voltage is 0 V, the temperature of the emission point 1 is equal.

Therefore, it would be apparent that when the gate voltage is at a voltage other than 0 V and 70 V, the amount of the heat generated in the tunnel current resistance component 22 is at constant. When the gate voltage is further elevated so that the emission amount of the electrons 10 becomes larger than 10 μA, the direction of the current flowing through the second cathode resistance component 23 is inverted. In the above mentioned embodiment, the end of the first cathode base conductor 2 is connected to the constant current 20, but even if the constant current 20 is connected to the second cathode side, a similar operation can be obtained.

Next, another modification of the field emitter in accordance with the present invention will be described with reference to FIG. 3. In this modification of the field emitter in accordance with the present invention, the first cathode 3 is formed of platinum silicide (PtSi) and has a resistance of 3Ω, and the conical insulator layer 5 is formed of a high resistance N-type silicon (1 kΩ·cm). The second cathode 4 is formed of molybdenum.

The platinum silicide forms a high Schottky junction of 0.8 eV against the N-type silicon, and the molybdenum forms a low Schottky junction of 0.6 eV against the N-type silicon. In the field emitter having the above structure is wired as shown in FIG. 4, the electron flow of 10 μA from the constant current source 20 flows through the Schottky junction between the platinum silicide and the N-type silicon, as a reverse direction current. Therefore, a large potential difference occurs at the junction portion, so that an electric power is consumed and therefore a heat is generated.

On the other hand, the electron flow of 10 μA flows through the Schottky junction between the molybdenum and the N-type silicon, with a low power consumption as a forward direction current. By the above mentioned action, the temperature is elevated centered on the tip end of the first cathode 3 which is the center rod of the tip end portion. If the temperature becomes too high, the carrier concentration of the N-type semiconductor elevates, so that the resistance component due to the rectifying characteristics decreases. Thus, excessive elevation of the temperature of the tip end portion is prevented.

Figure 5:
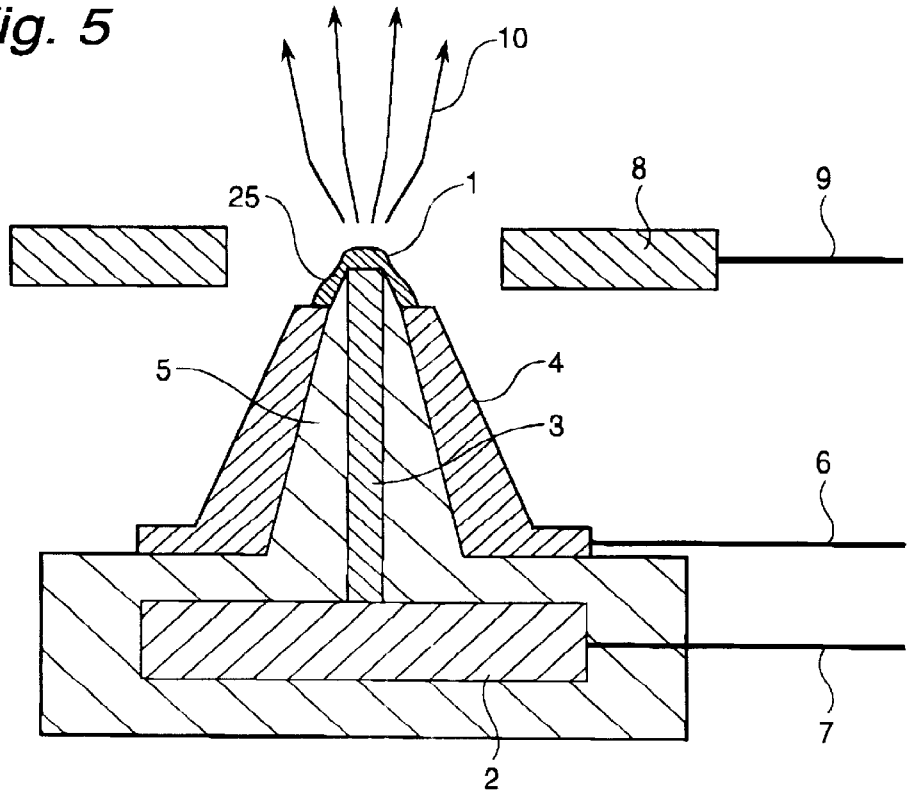
FIG. 5 is a sectional view illustrating the structure of a second embodiment of the field emitter in accordance with the present invention.

FIG. 5 is a sectional view illustrating the structure of a second embodiment of the field emitter in accordance with the present invention. In the drawing, the second embodiment of the field emitter in accordance with the present invention has a structure similar to that of the first embodiment of the field emitter in accordance with the present invention shown in FIG. 2, excepting that the emission point 1 is covered with a third cathode 25, and the first cathode 3 is covered with the third cathode 25 and the conical insulator layer 5, and therefore, the same constituents are given the same Reference Numerals.

In this embodiment, the first cathode 3 is maintained in no contact with a vacuum portion, by covering the first cathode 3 with the third cathode 25 and the conical insulator layer 5. The third cathode 25 is formed of a β-iron silicide ($\beta$-$FeSi_2$) which is a material showing a semiconductive electric conductivity of a high resistance.

Here, the semiconductive electric conductivity means a negative temperature dependency coefficient of the resistance, namely, the characteristics in which the higher the temperature is, the smaller the resistance is. In addition, a contact resistance between the first cathode 3 and the third cathode 25 and a contact resistance between the second cathode 4 and the third cathode 25 are negligibly small in comparison with the resistance of the third cathode 25.

Figure 6:
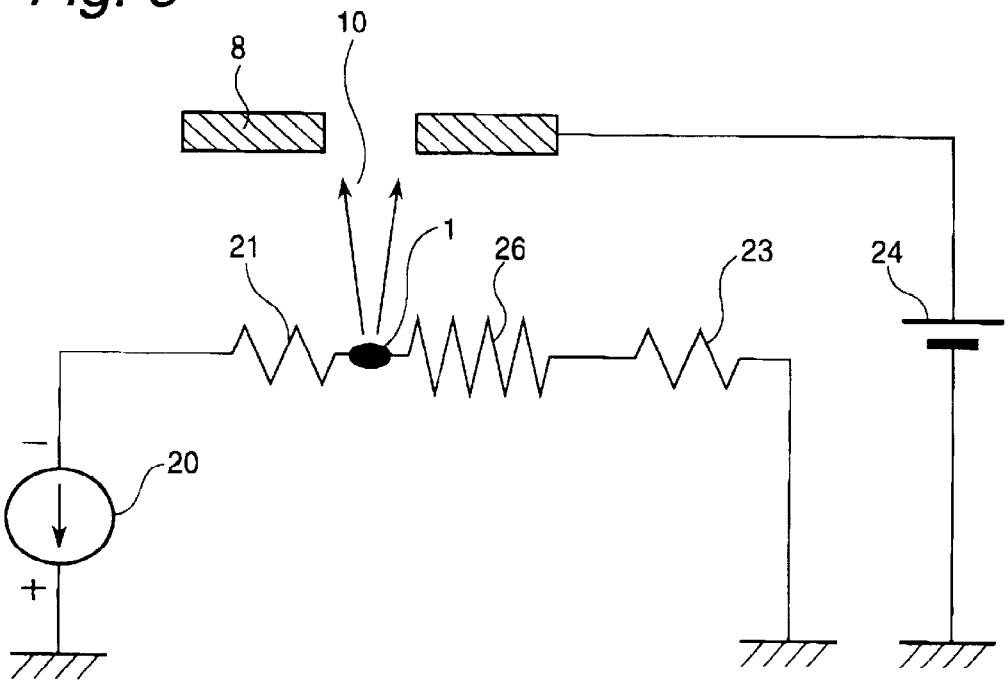
FIG. 6 is a circuit diagram illustrating the method for driving the second embodiment of the field emitter in accordance with the present invention.

FIG. 6 is a circuit diagram illustrating the method for driving the second embodiment of the field emitter in accordance with the present invention. In the drawing, an equivalent circuit of the second embodiment of the field emitter in accordance with the present invention has a construction similar to the equivalent circuit of the first embodiment of the field emitter in accordance with the present invention shown in FIG. 4, excepting that the resistance structure in the proximity of the emission point 1 is different, and therefore, the same constituents are given the same Reference Numerals.

In the second embodiment of the field emitter in accordance with the present invention, a resistance component 26 of the third cathode is located between the emission point 1 and the second cathode resistance component 23. Setting the constant current source 20 at 100 μA when the emission amount of the electrons 10 is 0 (zero), the current of 100 μA flows through the third cathode resistance component 26 which is a dominating resistance component, so that the heat is generated to 200° C.

The temperature is stabilized in a steady conduction of 200° C. since the resistance value lowers with elevation of the temperature. When the electrons are emitted, the electron flow flowing through the third cathode resistance component 26 is correspondingly decreased. Namely, when the electrons 10 are emitted, the heat generation in the third cathode is decreased.

In the above mentioned second embodiment of the present invention, since the first cathode 3 is in no contact with the vacuum, even if the temperature of this portion is elevated because of the heat generation of the third cathode 25, a heat loss caused by radiation is small in the tip end of the first cathode 3. Therefore, the elevated temperature can be maintained for a long term, so that the stability of the tip end condition can be elevated.

Figure 7:
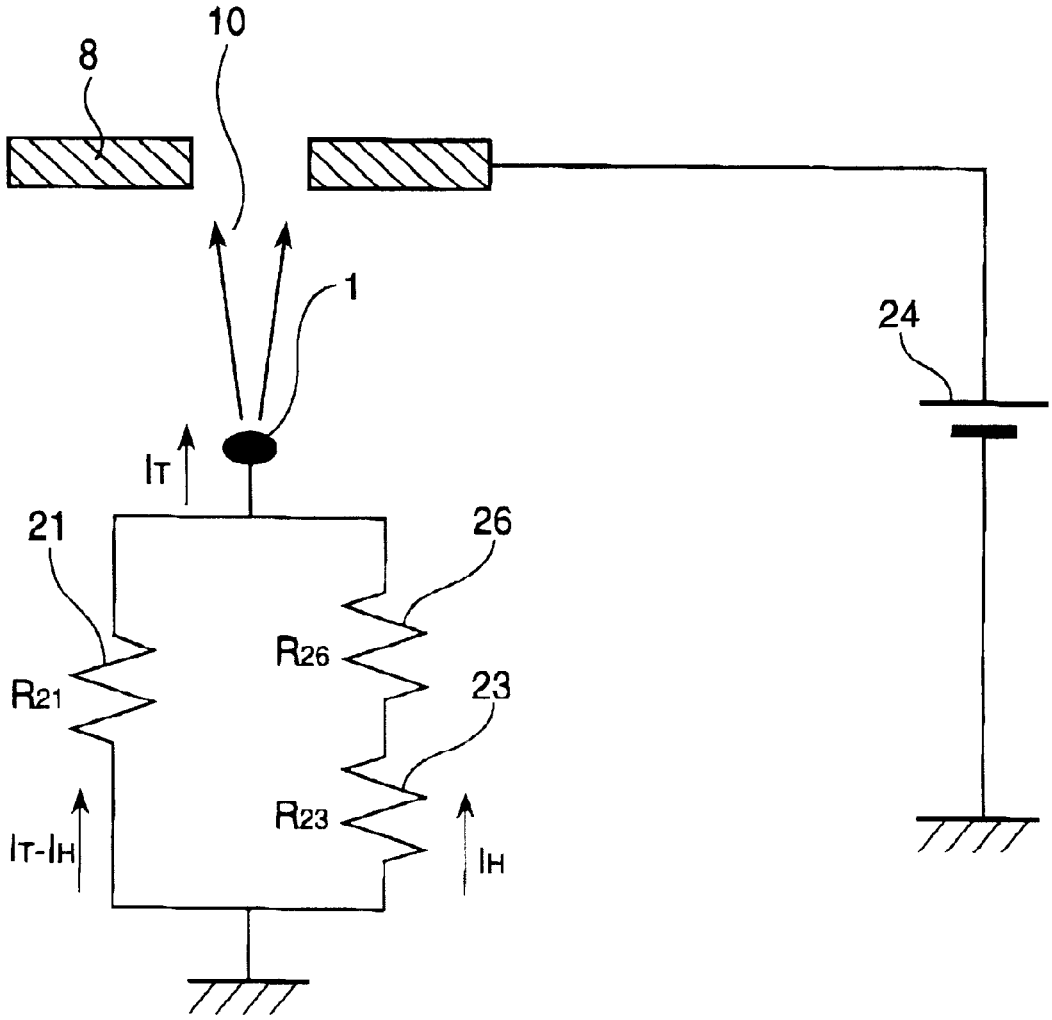
FIG. 7 is a diagram illustrating an equivalent circuit of a third embodiment of the field emitter in accordance with the present invention.

FIG. 7 is a diagram illustrating an equivalent circuit of a third embodiment of the field emitter in accordance with the present invention. In the drawing, the equivalent circuit of the third embodiment of the field emitter in accordance with the present invention has a construction similar to the equivalent circuit of the embodiment of the field emitter in accordance with the present invention shown in FIG. 5, excepting that electron supplying ends of the first cathode 3 and the second cathode 4 are connected, and therefore, the same constituents are given the same Reference Numerals.

The electron supplying indicate are ends of the first cathode 3 and the second cathode 4, which are different from the emission point. In FIG. 7, the first cathode resistance component 21, the second cathode resistance component 23 and the third cathode resistance component 26 are expressed by R21, R23 and R26, respectively.

The electrons 10 are emitted from the emission point 1 by action of the electric field created by the gate applying wiring conductor 9, which is separated from the cathode by vacuum. The emission amount of these electrons is expressed by IT. A current component flowing through the second cathode 4 and the third cathode 25 is expressed by IH.

From the Kirchhoff's current distribution rule, the electron flow flowing through the first cathode 3 is IT−IH. Accordingly, since the potential differences between opposite ends of circuits connected in parallel to each other become equal, the following relation holds in the equivalent circuit shown in FIG. 7:

$$R21\cdot(IT-IH)=(R23+R26)\cdot IH \quad (1)$$

Here, the resistance component dominantly determining the temperature of the emission point 1 is R26. In order to fulfill this assumption, a totally contrived structure is required in which, for example, the resistance of R26 is made to be high at some degree, and on the other hand, it is so designed that the electron flow flowing through R26 is large at some degree. Furthermore, in order to cause the generated heat amount to be effectively reflected to the temperature elevation, the heat capacity is made small, and the heat dissipation is minimized.

As mentioned hereinbefore, the structure has been contrived to cause the generated heat amount to be effectively reflected to the temperature elevation. In the equivalent circuit shown in FIG. 7, the heat amount C generated in R26 is given by the following equation as a Joule heat:

$$(IH)\cdot(IH)\cdot(R26)=C \quad (2)$$

Since IH can be eliminated by combining the equation (1) and the equation (2) into a simultaneous equation, the following equation can be obtained:

$$C \cdot R26 \cdot R26 + (2 \cdot C \cdot R21 - IT \cdot IT \cdot R21 \cdot R21) \cdot R26 + C \cdot R21 \cdot R21 = 0 \quad (3)$$

In order to obtain a constant heat amount C independently of a changing emitted electron flow IT, by putting R21 and R23 at constant values (fixed resistance values) in the equation (2), a required resistance characteristics of R26 can be determined by solving the equation (3) which is a quadratic equation for R26.

The solution of R26 has the characteristics changing dependently upon IT, namely, shows the resistance value changing dependently upon the current. By forming R26 of the Schottky junction, various resistance characteristics can be obtained. A desired characteristics can be obtained by optimally selecting the temperature characteristics of the resistance since the portion of R26 is a portion changing substantially dependently upon the temperature. Furthermore, the range of selection can be enlarged by making variable the resistance components of R21 and R23 which have been described to be fixed in the above explanation.

In addition, the range of selection can be enlarged by adjusting the temperature of the emission point 1 while incorporating the heat generating effect of R21 and R23 which have been ignored in the above explanation. As regards the heat dissipation, a structure of making the radiation efficiency and the head capacity variable can be adopted.

The heat generation is not limited to the Joule heat, but can be realized by utilizing a heat generation of a capacitor or an inductor driven by an AC power. In this case, the optimization is carried out by adding a capacitance component or an inductance component into the equivalent circuit.

The structure shown in FIG. 7 has a restriction that when the electron flow is completely 0 (zero), heat cannot be generated. However, even if the electron emission is 0 (zero), the temperature adjustment can be realized by ensuring a minute leak current path between the resistance components and the gate wiring conductor which should be inherently insulated from each other, or by ensuring an irregular electron flow which is directed to the gate wiring conductor and which is not substantially considered to be an electron emission.

In the above explanation, it has been described that the temperature of the emission point 1 is maintained at a constant independently of the electron emission amount. However, it is possible to adjust the characteristics of the respective resistances so as to maintain at a constant the characteristics of the emitted electron flow in relation to the gate applied voltage, independently of the emission history, in place of maintaining the temperature at a constant.

Here, the emission history means a phenomenon in which, for example, the electron emission amount when 70 V is applied just after a large electron flow of 1 mA is emitted by applying the gate voltage of 100 V, is different from the electron emission amount when 70 V is applied just after an electron flow of about 0.01 mA is emitted by applying the gate voltage of 40 V. Namely, the electron emission amount is different even under the same voltage. The influence of the duration of the electron flow emitted just before is treated as the emission history.

As mentioned above, by causing the electrons to be emitted from the sharpened projection by action of the field emission, and by providing a plurality of electron supplying conductors in contact with the projection, it is possible to selectively heat the projection for emitting the electrons. The current flowing between the plurality of electron supplying conductors generates a Joule heat by the resistance component of the conductor itself or the contact resistance in the projection, so that the projection is heated.

Furthermore, by causing the electrons to be emitted from the sharpened projection by action of the field emission, by providing a plurality of electron supplying conductors in contact with the projection, and by making their contact portion a rectifying contact, it is possible to control the temperature elevation since the amount of the Joule heat generated by the resistance is different depending upon the direction of the current flowing through the conductors. Therefore, the temperature can be precisely controlled by frequently adjusting the current direction and the distribution in time of the current direction.

Still furthermore, by causing the electrons to be emitted from the sharpened projection by action of the field emission, by providing a plurality of electron supplying conductors in contact with the projection, and by maintaining one conductor of the plurality of electron supplying conductors in no contact with vacuum, it is possible to reduce the dissipation of the Joule heat generated in the conductor resistance component or the contact resistance by action of a radiation cooling, so that the heading efficiency of the electron emitting projection can be elevated.

Moreover, by causing the electrons to be emitted from the sharpened projection by action of the field emission, by providing a plurality of electron supplying conductors in contact with the projection, and by making the total of the currents flowing through the plurality of electron supplying conductors equal to the amount of the electron flows emitted by action of the field emission, since all of current used for the heating is emitted as the electrons, it is possible to make it unnecessary to flow an extra current for emission of electrons.

By using the field emitter having the above mentioned structure, since the temperature of the emission point can be efficiently maintained at a constant temperature, it is possible to obtain the electron emission which does not depend upon the electron emission history but which depends upon the gate applied voltage with a good repeatability.

Since the electric power consumption required to obtain the above characteristics is small, and since the temperature of a localized portion having only a small heat capacity is adjusted, the adjustment response is fast. In addition, since the structure is simple, and since an occupying area is small, it is possible to incorporate the field emitter while preventing the increase of the cost.

As mentioned above, according to the present invention, in the field emitter configured to cause the electrons to be emitted from the sharpened projection by action of the field emission, by providing a plurality of electron supplying conductors in contact with the projection, it is advantageous to be able to efficiently maintain the temperature of the emission point at a constant temperature.

What is claimed is:

1. A field emitter configured to cause electrons to be emitted from a sharpened projection by action of a field emission, comprising a plurality of electron supplying conductors in contact with said projection, wherein a contact between said projection and said plurality of electron supplying conductors is a rectifying contact.

2. A field emitter claimed in claim 1 wherein one conductor of said plurality of electron supplying conductors is maintained in no contact with vacuum.

3. A field emitter claimed in claim 1 wherein the total of the currents flowing through said plurality of electron supplying conductors is equal to the amount of the electron flow emitted by action of the field emission.

4. A field emitter comprising first and second cathodes for supplying electrons to an emission point for emitting electrons by action of a field emission, and first and second cathode applying wiring conductors connected to said first and second cathodes, respectively.

5. A field emitter claimed in claim 4, further including a gate metal film for applying a strong electric field to said emission point and a gate applying wiring conductor connected to said gate metal film.

6. A field emitter claimed in claim 5, further including a conical insulator layer for insulating said first and second cathodes from each other, wherein a contact between said first and second cathodes and said conical insulator layer is a rectifying contact.

7. A field emitter claimed in claim 4, further including a conical insulator layer for insulating said first and second cathodes from each other, wherein a contact between said first and second cathodes and said conical insulator layer is a rectifying contact.

8. A field emitter comprising a first cathode for supplying electrons to an emission point for emitting electrons by action of a field emission, said first cathode having one end sharpened in the form of a conical tip end, a second cathode for supplying electrons to said emission point for emitting the electrons by action of the field emission, first and second cathode applying wiring conductors connected to said first and second cathodes, respectively, a conical insulator layer for insulating said first and second cathodes from each other, and a third cathode covering said emission point and surrounding said first cathode by cooperation with said conical insulator layer.

9. A field emitter comprising a first cathode for supplying electrons to an emission point for emitting electrons by action of a field emission, said first cathode having one end sharpened in the form of a conical tip end, and a second cathode for supplying electrons to said emission point for emitting the electrons by action of the field emission, said second cathode being connected to the other end of said first cathode. the total of the currents flowing through said first and second cathodes being equal to the amount of the electron flow emitted by action of the field emission.

* * * * *